US006890145B2

(12) United States Patent
Takamine et al.

(10) Patent No.: US 6,890,145 B2
(45) Date of Patent: May 10, 2005

(54) VACUUM PUMP

(75) Inventors: Masayoshi Takamine, Narashino (JP); Yasushi Maejima, Narashino (JP); Shinji Kawanishi, Narashino (JP); Yoshiyuki Sakaguchi, Narashino (JP); Satoshi Okudera, Narashino (JP); Kenji Kabata, Narashino (JP); Yutaka Inayoshi, Narashino (JP)

(73) Assignee: BOC Edwards Technologies Limited, Narashino (JP)

( * ) Notice: Subject to any disclaimer, the term of this patent is extended or adjusted under 35 U.S.C. 154(b) by 14 days.

(21) Appl. No.: 10/294,826

(22) Filed: Nov. 14, 2002

(65) Prior Publication Data

US 2003/0095860 A1 May 22, 2003

(30) Foreign Application Priority Data

Nov. 16, 2001 (JP) ..... 2001-352256

(51) Int. Cl.[7] ..... F04D 19/04

(52) U.S. Cl. ..... 415/90; 416/241 R; 416/500; 415/217.1

(58) Field of Search ..... 416/241 R, 241 A, 416/144, 500; 415/90, 217.1, 216.1, 200; 74/573 R

(56) References Cited

U.S. PATENT DOCUMENTS 4,832,993 A 5/1989 Coulon ..... 427/53.1
5,350,275 A * 9/1994 Ishimaru ..... 415/90
5,536,148 A * 7/1996 Nishiuchi et al. ..... 417/203
5,938,406 A 8/1999 Cerruti ..... 416/241
6,164,945 A 12/2000 Ishibashi ..... 418/206.5

FOREIGN PATENT DOCUMENTS

DE 4239391 6/1993
EP 0799999 10/1997

OTHER PUBLICATIONS

Patent Abstracts of Japan vol. 013, No. 020 (m–785), Jan. 18, 1989 Publication No. 63 230989 A (Hitachi Ltd), Publication Date Sep. 27, 1988.

* cited by examiner

*Primary Examiner*—F. Daniel Lopez
*Assistant Examiner*—Dwayne White
(74) *Attorney, Agent, or Firm*—Adams & Wilks

(57) ABSTRACT

A vacuum pump has a pump case having a gas suction port at an upper surface thereof, a rotor shaft mounted in the pump case for undergoing rotation, and a rotor connected to the rotor shaft for rotation therewith. The rotor has inner and outer circumferential surfaces coated with a corrosion-resistant film treated by nonelectrolytic plating. Rotor blades are disposed in the pump case and are integrally connected to the outer circumferential surface of the rotor. Stator blades are integrally connected to the pump case so that the rotor blades and the stator blades are alternately positioned and arranged. A balancing body is disposed on the inner circumferential surface of the rotor for balancing the rotor during rotation thereof.

27 Claims, 4 Drawing Sheets

VACUUM PUMP

BACKGROUND OF THE INVENTION

1. Field of the Invention

The present invention relates to vacuum pumps used in semiconductor manufacturing apparatus, and more particularly, the present invention relates to the structure of a vacuum pump for balancing a rotating body of the vacuum pump.

2. Description of the Related Art

In process such as dry etching, chemical vapor deposition (CVD), or the like performed in a high-vacuum process chamber in a semiconductor manufacturing step, a vacuum pump such as a turbo-molecular pump is used for producing a high vacuum in the process chamber by exhausting gas from the process chamber.

A rotating body of such a turbo-molecular pump is usually formed of an aluminum alloy. In the turbo-molecular pump used under severe circumstances, for example, exposure to a corrosive gas such as a gaseous chlorine or a fluorine sulfide gas, the aluminum-alloy rotating body has a corrosion-resistant film on the surface thereof, for example, coated by nonelectrolytic plating such as nickel-phosphor-alloy plating or the like.

The turbo-molecular pump as described above is required for balancing the rotating body rotating at high speed during its assembly process. A conventional way of finely balancing is performed by carving out of a part of the circumferential outer or inner surface of the rotating body with a drill or a router so as to change the mass of the rotating body.

According to the conventional way of balancing achieved by carving out of a part of the surface of the rotating body, since a drill or a router carves out a part of the corrosion-resistant film coated on the surface of the rotating body, the corresponding part of the aluminum alloy under the corrosion-resistant film is exposed to the outside and is accordingly subjected to corrosion. A stress corrosion crack of the carved part of the rotating body caused by the corrosion develops during the high speed rotation of the rotating body, and eventually results in the breaking of the rotating body in the worst case.

An alternative way of finely balancing the rotating body is achieved such that, instead of carving out of a part of the rotating body, a mass such as a weight is added to the surface of the rotating body having a corrosion-resistant film thereon so as to change the mass of the rotating body while preventing the rotating body from being corroded. However, according to the above-mentioned mass-addition way of balancing, the mass is likely to be flaked off from the surface of the rotating body due to the centrifugal force of the rotating body during at a high speed, thereby making it difficult to maintain the balance of the rotating body for a long period of time.

The present invention is made in view of the above-described problems. Accordingly, it is an object of the present invention to provide a vacuum pump in which a rotation body can avoid being broken due to corrosion and the balance thereof can be maintained for a long period of time.

SUMMARY OF THE INVENTION

A vacuum pump according to the present invention comprises a pump case forming a gas suction port at the upper surface thereof; a rotor shaft rotatably supported in the pump case; a rotor being formed a corrosion-resistant film treated by nonelectrolytic plating on the inner and outer circumferential surfaces of the rotor; a plurality of rotor blades accommodated in the pump case and integrally formed with an outer circumferential surface of the rotor; a plurality of stator blades fixed in the pump case such that the rotor blades and the stator blades are alternately positioned and arranged; a drive motor for rotating the rotor shaft; and mass-addition means formed by applying an adhesive or a coating, having heat and corrosion resistances, on the inner circumferential surface of the rotor.

Also, another vacuum pump according to the present invention comprises a pump case forming a gas suction port at the upper surface thereof; a rotor shaft rotatably supported in the pump case; a rotor being formed a corrosion-resistant film treated by nonelectrolytic plating on the inner and outer circumferential surfaces of the rotor, wherein a groove is formed on the inner circumferential surface of the rotor; a plurality of rotor blades accommodated in the pump case and integrally formed with an outer circumferential surface of the rotor; a plurality of stator blades fixed in the pump case such that the rotor blades and the stator blades are alternately positioned and arranged; a drive motor for rotating the rotor shaft; and mass-addition means formed by filling an adhesive or a coating, having heat and corrosion resistances, into the grooves formed on the inner circumferential surface of the rotor.

According to the present invention, the adhesive having heat and corrosion resistances is preferably a synthetic resin adhesive consisting of a resin selected from the group consisting of an epoxy resin, a silicon resin, a polyamide resins and a polyimide resin.

The adhesive having heat and corrosion resistances contains a stainless steel powder or ceramic fibers consisting of a metal oxide such as an aluminum oxide ($Al_2O_3$), a silicon oxide ($SiO_2$), and a chromium oxide ($Cr_2O_3$).

According to the present invention, the coating having heat and corrosion resistances may consist of an alkyd resin.

In addition, according to the present invention, the mass-addition means is preferably filled into the groove so as to be flush with the inner circumferential surface of the rotor.

Furthermore, a vacuum pump according to the present invention comprises a pump case forming a gas suction port at the upper surface thereof; a rotor shaft rotatably supported in the pump case; a rotor; a plurality of rotor blades accommodated in the pump case and integrally formed with an outer circumferential surface of the rotor; a plurality of stator blades fixed in the pump case such that the rotor blades and the stator blades are alternately positioned and arranged; a drive motor for rotating the rotor shaft; a stainless steel washer for a bolt for fastening the rotor to the rotor shaft, integrally formed with an outer circumferential surface of the rotor shaft; and mass-addition means formed by attaching at least one weight, selected from the group consisting of a screw, a cotter pin, and a bushing, to the annular surface of the washer.

In this case, a gas vent hole may be bored in the axial center of the weight.

DETAILED DESCRIPTION OF THE PREFERRED EMBODIMENTS

Vacuum pumps according to preferred embodiments of the present invention will be described with reference to the accompanying drawings.

Figure 1:
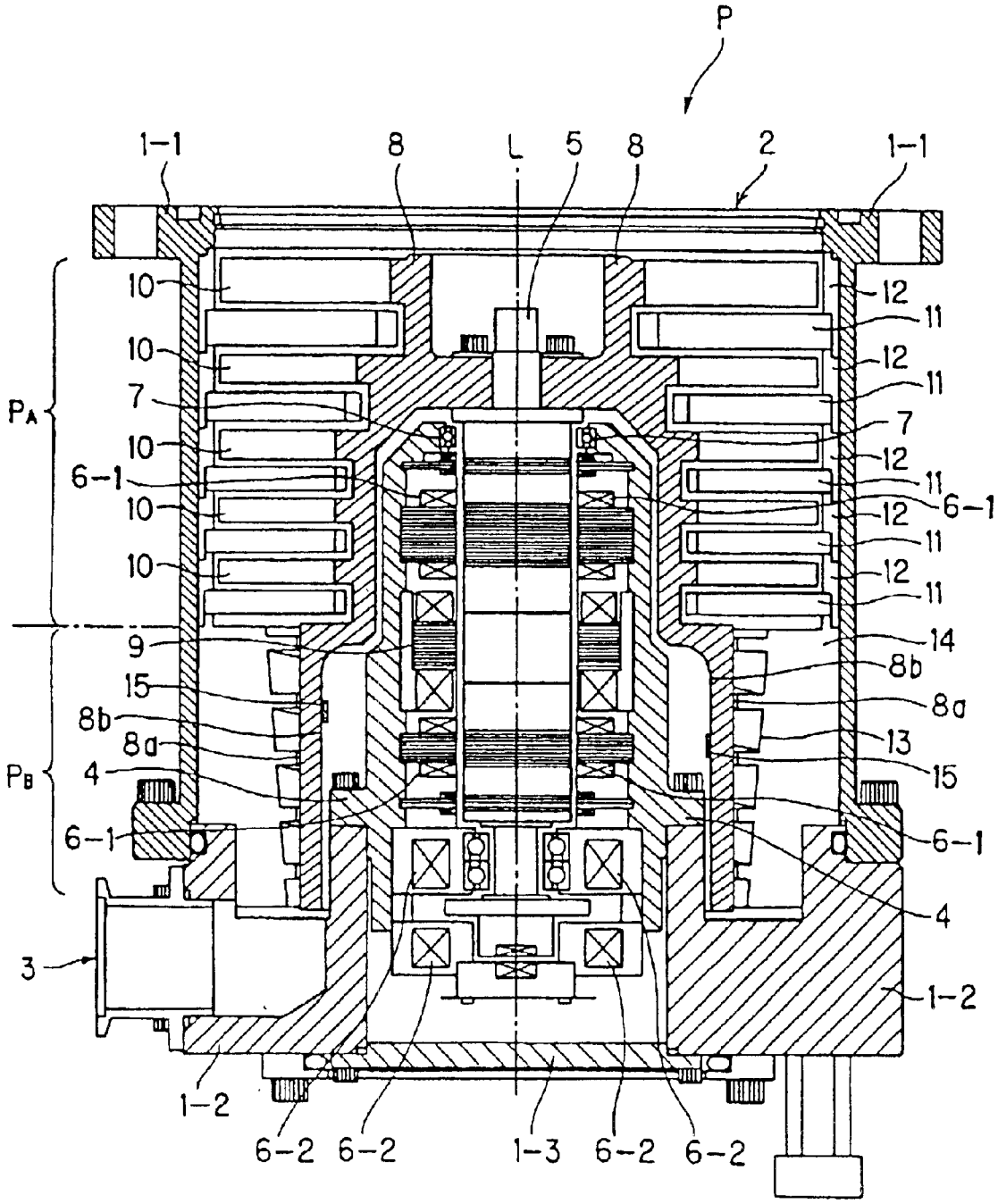
FIG. 1 is an elevational view in section of a structure of the vacuum pump according to the present invention.

FIG. 1 is an elevational view in section of a structure of the first embodiment of the vacuum pump according to the present invention.

As shown in FIG. 1, a vacuum pump P according to the first embodiment has two main parts, that is, a pump case 1, which is composed of a cylindrical portion 1-1 and a base 1-2 attached and fixed to the lower end thereof, and a pump mechanism portion accommodated in the pump case 1.

The pump case 1 has an opening in the upper surface thereof serving as a gas suction port 2, to which a vacuum vessel (not shown) such as a process chamber is fastened by bolts, and an exhaust gas pipe serving as a gas vent 3 at a lower portion of the pump case 1.

The bottom of the pump case 1 is covered with the bottom end plate 1-3, and a stator column 4 is provided so as to be erected from the central part of the bottom end plate 103 in the pump case 1 and is fastened to the base 1-2 by bolts in a standing manner.

The rotor column 4 has a rotor shaft 5, which passes through both end surfaces of the rotor column 4, and radial electromagnets 6-1 and axial electromagnets 6-2 therein serving as magnetic bearings. The rotor shaft 5 is rotatably supported by the radial and axial electromagnets 6-1 and 6-2 in the radial and axial directions thereof, respectively. The rotor column 4 also has ball bearings 7, to which a dry lubricant is applied, wherein the ball bearing 7 support the rotor shaft 5 and prevent the rotor shaft 5 from coming into contact with the electromagnets 6-1 and 6-2 in case of a power failure of the foregoing electromagnets. The ball bearings 7 do not come into contact with the rotor shaft 5 during normal operation.

A cylindrical rotor 8 composed of an aluminum alloy or the like is provided in the pump case 1. A corrosion-resistant film, which has a thickness of about 20 $\mu$m, is coated by nonelectrolytic plating such as nickel-phosphor-alloy plating or the like, on the surface of the rotor 8. The rotor 8 is disposed so as to surround the stator column 4 and fastened to the rotor shaft 5 with bolts. Also, the uppermost portion of the rotor 8 extends toward the vicinity of the gas suction port 2.

A drive motor 9, such as a high-frequency motor, is disposed between the rotor shaft 5 and the stator column 4 and also at the central part of the rotor shaft 5 so that the drive motor 9 drives the rotor shaft 5 and the rotor 8 to rotate at high speed.

The pump mechanism portion of the first embodiment of the vacuum pump P according the present invention is accommodated in the pump case 1 and employs a combined pump mechanism composed of an upper half as a turbo molecular pump mechanism portion $P_A$ and a lower half as a groove pump mechanism portion $P_B$, both disposed in the space between the inner circumferential surface of the pump case 1 and the outer circumferential surface of the rotor 8.

The turbo molecular pump mechanism portion $P_A$ is composed of rotor blades 10, which rotate at high speed, and stationary fixed stator blades 11.

More particularly, a plurality of rotor blades 10 are integrally formed on an outer circumferential surface of the upper half of the rotor 8, in a direction along the rotation axis L of the rotor 8, beginning from the uppermost portion of the rotor 8 close to the gas suction port 2. Also, the plurality of stator blades 11 are fixed to the inner circumferential surface of the upper half of the pump case 1 via a plurality of spacers 12 in a manner such that the rotor blades 10 and the stator blades 11 are alternately positioned and arranged in a direction along the rotation axis L.

On the other hand, the groove pump mechanism portion $P_B$ is composed of an outer circumferential surface 8*a* of the rotor 8 which rotates at a high speed and a plurality of stationary thread grooves 13.

More particularly, the outer circumferential surface of the lower half of the rotor 8 is the plain outer circumferential surface 8*a*. A cylindrical threaded stator 14 is disposed on the inner circumferential surface of the lower half of the pump case 1. Also, the threaded stator 14 faces the outer circumferential surface 8*a* via a small gap and has the thread grooves 13 carved thereon.

Alternatively, the threaded grooves 13 may be carved on the outer circumferential surface of the lower half of the rotor 8, and the outer surface, which faces the rotor 8, of the threaded stator 14 disposed on the inner circumferential surface of the pump case 1 may be formed as a plain cylindrical surface.

The vacuum pump P according to the first embodiment is characterized in that, by applying an adhesive or a coating having heat and corrosion resistances, mass-addition means 15 is provided on a inner circumferential surface 8*b* of the lower half of the rotor 8 which is composed of an aluminum apply or the like and which has a corrosion-resistant film formed on the surface thereof.

Figure 2:
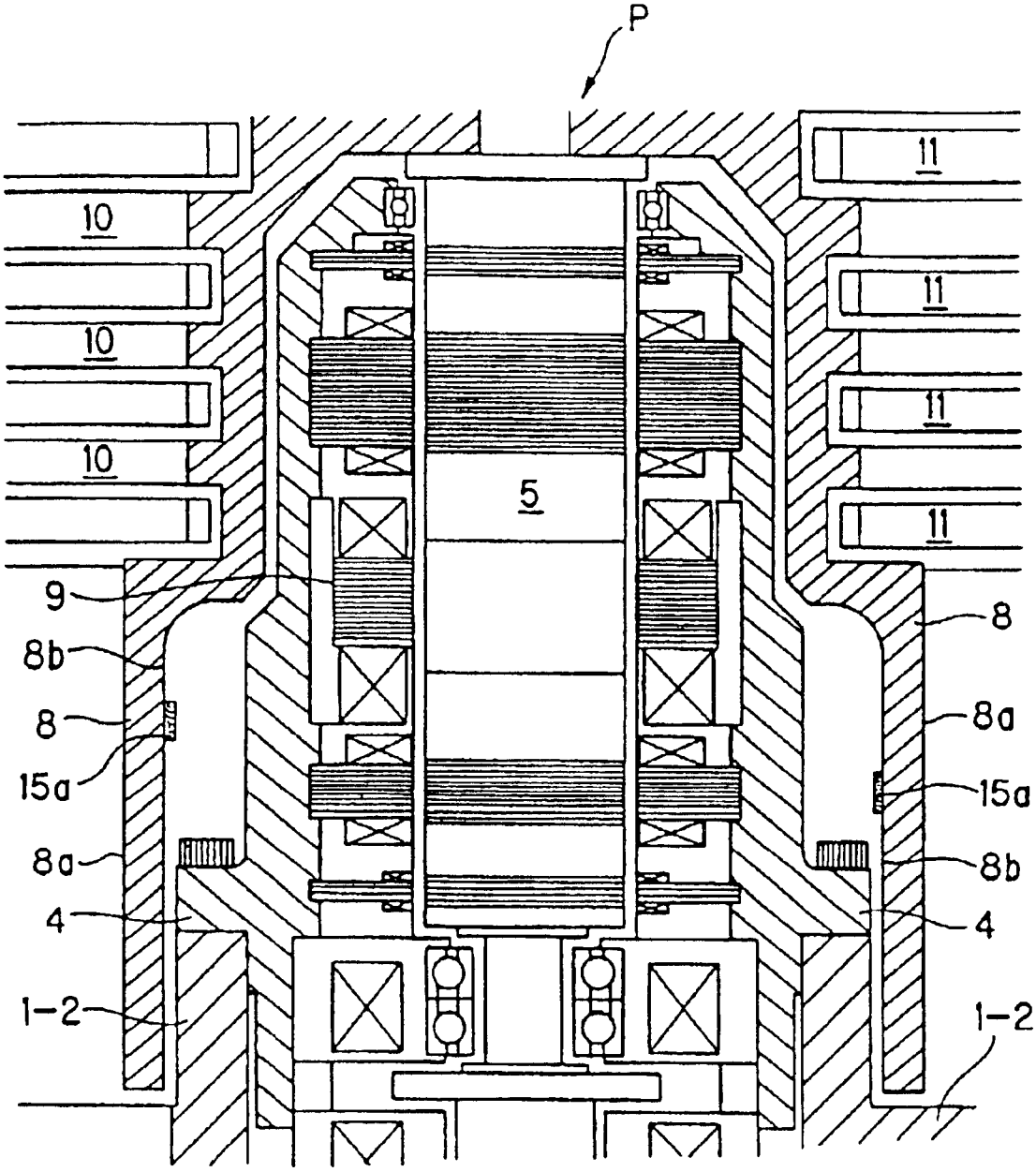
FIG. 2 is a partially magnified elevational view in section of a rotor shown in FIG. 1.

As shown in FIG. 2, by applying a synthetic resin adhesive 15*a* such as an epoxy resin, a silicon resin, a polyamide resin, or a polyimide resin, having heat and corrosion resistances, on the inner circumferential surface 8*b* of the rotor 8 so as to have a thickness of about 2 to 10 $\mu$m, and by curing the applied synthetic resin adhesive 15*a* at room temperature or by heat, a mass serving as the mass addition means 15 is added to the inner circumferential surface 8*b* of the rotor 8. Thus, the balance of the rotating body consisting of the rotor shaft 5, the rotor 8, and the rotor blades 10 can be finely performed.

The foregoing adhesive 15*a* having heat and corrosion resistance properties may contain a stainless steel powder or ceramic fibers consisting of a metal oxide such as an aluminum oxide ($Al_2O_3$), a silicon oxide ($SiO_2$), and a chromium oxide ($Cr_2O_3$), as a metal powder having a higher density than the adhesive.

When the adhesive 15*a* contains one of the above metal powders, the powder particles are preferably are pulverized so as to have a diameter of 10 $\mu$m or less. When the particles have a diameter greater than 10 $\mu$m, the metal powder is precipitated in a solvent, thereby making the metal powder and the adhesive difficult to be uniformly kneaded. On the contrary, when the particles have a diameter equal to or less than 10 $\mu$m, the metal powder remains dissolved in the solvent, and thus the metal powder and the adhesive can be uniformly kneaded.

In place of the foregoing synthetic resin adhesive 15*a*, a coating which is composed of an alkyd resin or the like and which has heat and corrosion resistance properties may be applied.

As described above, since the synthetic resin adhesive 15*a* is applied on the inner circumferential surface 8*b* of the rotor 8, and the adhesive 15*a* is forced toward the rotor blades 10 due to the centrifugal force of the rotor 8 during rotation at high speeds. As a result, the adhesive 15*a* does not require a strong bonding force and is not flaked off from the inner circumferential surface 8*b* by the centrifugal force.

Also, since a purge gas (an inactive gas) is filled into the inside space of the rotor 8 where the synthetic resin adhesive 15*a* is applied, and the synthetic resin adhesive 15*a* is accordingly hardly affected by the exhausting gas, the adhesive 15*a* is not corroded by a corrosive gas such as a gaseous chlorine, or a fluorine sulfide gas.

Consequently, in the vacuum pump P having the above-described structure, the rotor 8 can be prevented from being broken due to corrosion caused by a corrosive gas, and also the balance of the rotating body can be maintained for a long period of time.

Next, the second embodiment of the vacuum pump according to the present invention will be described with reference to FIG. 3.

Since basic structure of a vacuum pump is same as that of the pump shown in FIG. 1. Therefore, the entire explanation will be omitted and the same numerals and symbols will be used designate the same component in the description.

Figure 3:
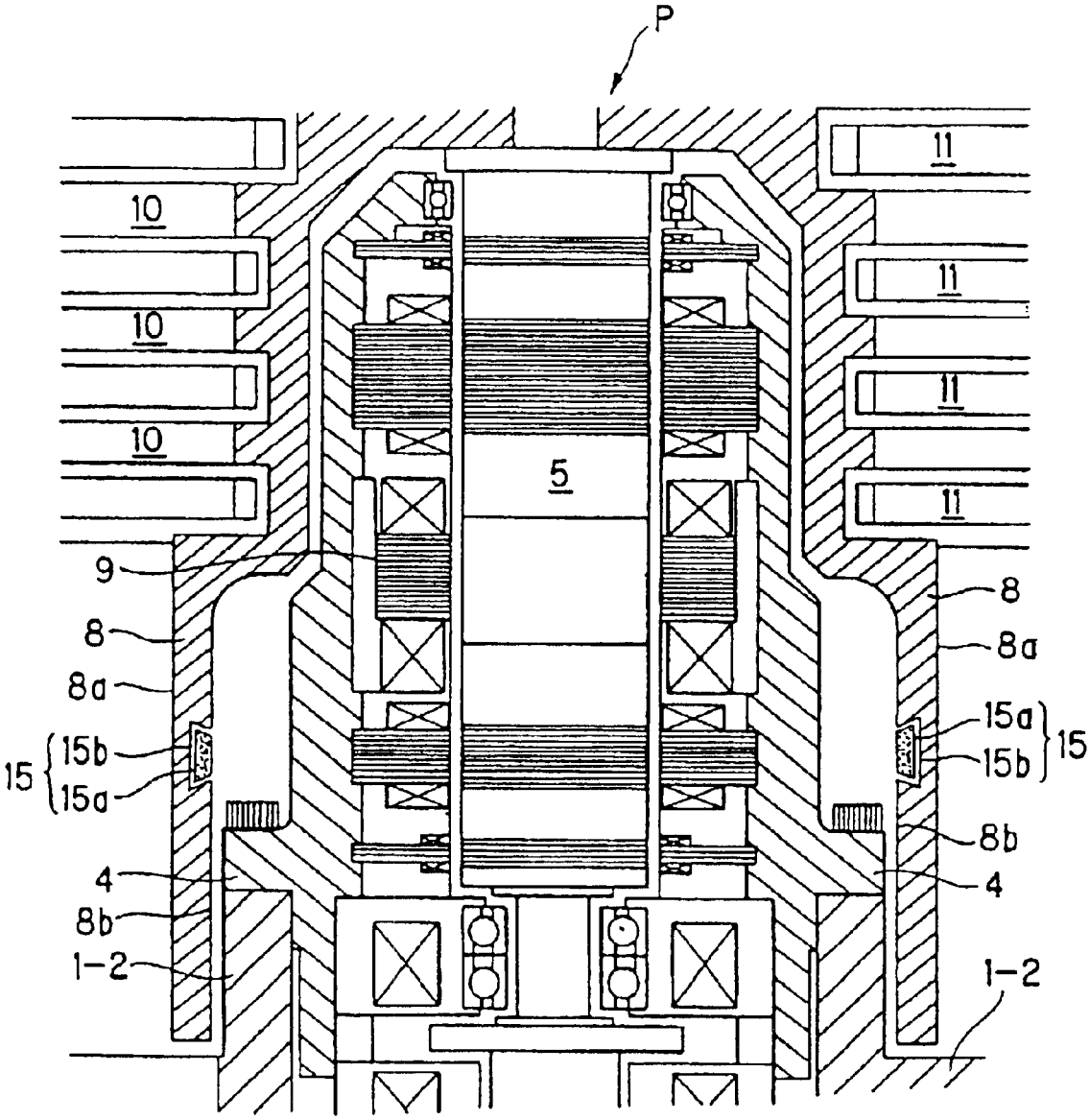
FIG. 3 is partially a magnified elevational view in section of the rotor shown in FIG. 1 for illustrating a modification of mass-addition means.

The second embodiment of the vacuum pump P according to the present invention is characterized in that, as a modification of the above-described mass-addition means 15 for balancing the rotating body, mass-addition means 17 is provided in a groove which is formed on the inner circumferential surface 8*b* of the rotor 8, as shown in FIG. 3.

More particularly, a dovetail groove 15*b* shown in FIG. 3 is formed by carving out of the inner circumferential surface 8*b* with a drill or a router, and an adhesive 15*a* having heat and corrosion resistance properties is filled into the dovetail groove 15*b* so as to be flush with the inner circumferential surface 8*b*.

In a similar fashion to that in the first embodiment, the adhesive 15*a* filled into the dovetail groove 15*b* is a synthetic resin adhesive which has heat and corrosion resistances and which is composed of an epoxy resin, a silicon resin, a polyamide resin, a polyimide resin, or the like, or a coating which has heat and corrosion resistances and which is composed of an alkyd resin or the like. The synthetic resin adhesive may contain a stainless steel powder or ceramic fibers consisting of a metal oxide such as an aluminum oxide ($Al_2O_3$), a silicon oxide ($SiO_2$), and a chromium oxide ($Cr_2O_3$).

Although not shown in the figure, in place of the foregoing dovetail groove 15*b*, an annular groove may be formed on the inner circumferential surface 8*b* of the rotor 8 and the foregoing adhesive 15*a* may be filled into the annular groove.

In the vacuum pump P having the above-described structure for balancing the rotating body, the rotor 8 has neither an irregularity nor a cut for balancing on the inner circumferential surface 8*b*. Accordingly, the rotor 8 is free from stress concentration due to rotation at high speed and thus has a reduced maximum stress, thereby leading to a reduced risk of the breaking of the rotor 8.

The third embodiment of the vacuum pump according to the present invention will be described with reference to FIG. 4.

Since basic structure of a vacuum pump is same as that of the pump shown in FIG. 1. Therefore, the entire explanation will be omitted and the same numerals and symbols will be used designate the same component in the description.

Figure 4:
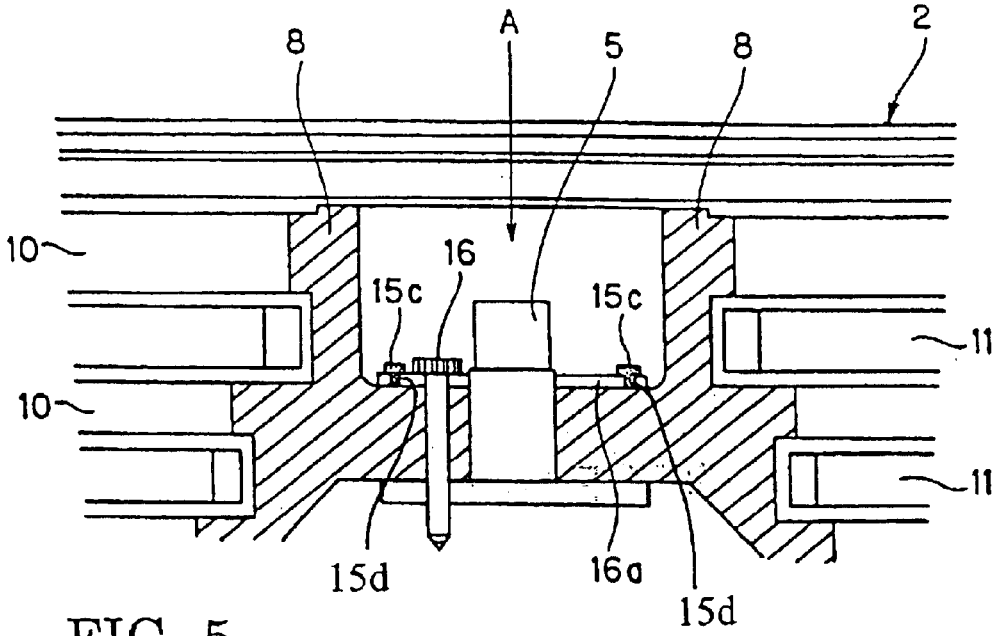
FIG. 4 is a partially magnified elevational view in section of the rotor for illustrating another modification of the mass-addition means.

The third embodiment of a vacuum pump P according to the present invention is characterized in that, as a further modification of the mass-addition means 15 for balancing the rotating body, a weight such a screw 15 is provided to the inner circumferential surface of a washer 16*a* used for bolts 16 fastening the rotor 8 to the rotor shaft 5, as shown in FIG. 4.

Figure 5:
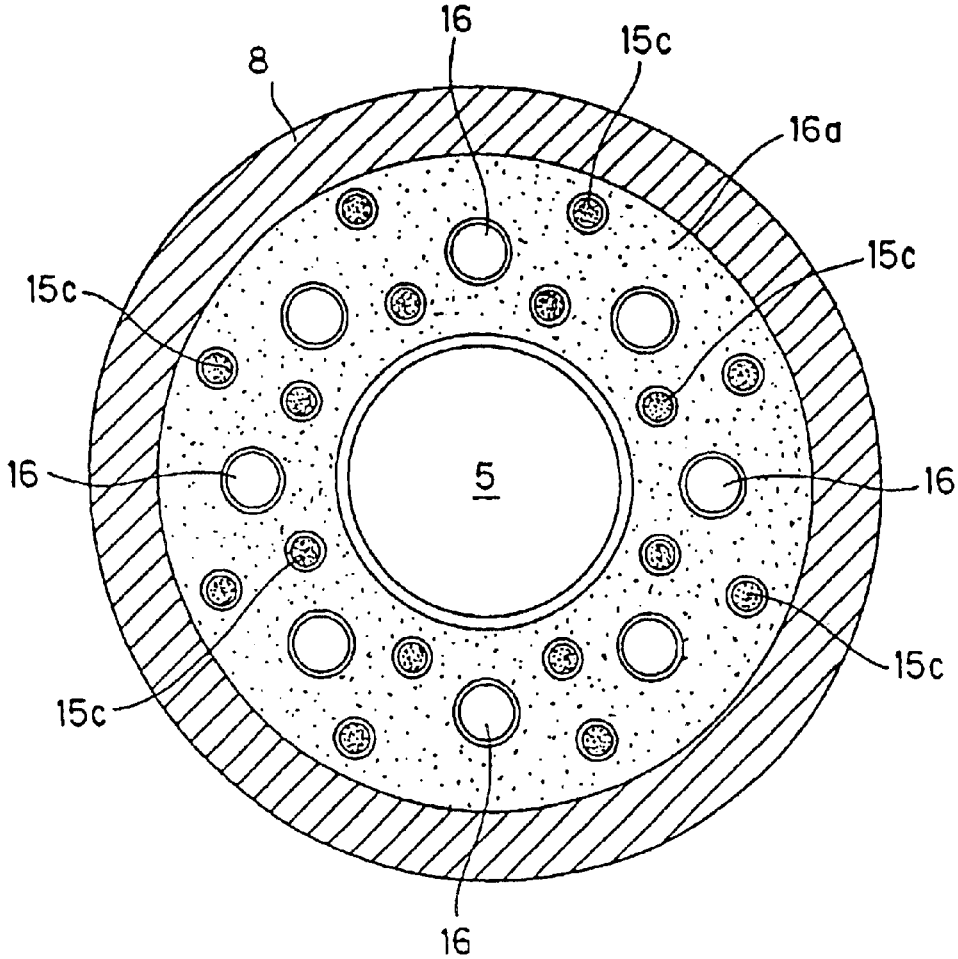
FIG. 5 is a top view of the rotor viewed from the arrow A indicated in FIG. 4.

More particularly, the washer 16*a* used for the bolt 16 is composed of a stainless steel having a larger specific gravity than that of an aluminum alloy and has an excellent strength against the centrifugal force. As shown in FIGS. 4 and 5 the ring washer 16*a* is integrally formed with an outer circumferential surface of the rotor shaft 5, has a plurality of screw holes 15*d* which have a diameter of about 3 to 5 mm and which are formed in the inner circumferential surface of the washer 16*a* in all directions. A mass-addition means 15 is achieved by attaching the screws 15*c*, composed of a heavy metal which contains a tungsten carbide or the like and which has a large specific gravity, into the screw holes 15*d*.

The mass-addition means 15 may be achieved by using cotter pins or bushings as the weights in place of the foregoing screws 15*c*.

Although not shown in the figure, the weight may have a small perforation in the axial center thereof so as to serve as a gas vent hole.

In the vacuum pump P having the above described structure of the third embodiment according to the present invention, as the mass-addition means 15 for balancing the rotating body, the weights having large specific gravities such as screws, cotter pins, bushings, or the like can be disposed closed to the axial center of the rotor shaft 5. As a result, balancing the rotating body can be performed effectively.

In addition, since the washer 16*a* used for the bolts 16 is made of a stainless steel, the washer 16*a* has a corrosion resistance against a corrosive gas such as a gaseous chlorine, a fluorine sulfide gas, or the like. Therefore, even when the washer 16*a* has holes for attaching the foregoing weights such as screws, cotter pins, bushings, or the like thereinto, the washer 16*a* is free from corrosion caused in the holes. As a result, the vacuum pump P prevents the rotor 8 from being broken due to the corrosion and also maintains the balance of the rotating body for a long period of time.

As described above, in the vacuum pump according to the present invention, the mass-addition means for balancing the rotating body is achieved by applying an adhesive or a coating having heat and corrosion resistance properties on the inner circumferential surface of the rotor or by integrally forming with the rotor shaft a stainless steel washer which is used for the bolts for fastening the rotor shaft to the rotor, and also by attaching the weights in the annular part of the washer. With this structure, the vacuum pump prevents the rotor from being broken due to corrosion and also effectively maintains the balance of the rotating body for a long period of time.

What is claimed is:

1. A vacuum pump comprising:

a pump case having a gas suction port at an upper surface thereof;

a rotor shaft mounted in the pump case for undergoing rotation;

a rotor connected to the rotor shaft for rotation therewith, the rotor having inner and outer circumferential surfaces coated with a corrosion-resistant film treated by nonelectrolytic plating;

a plurality of rotor blades disposed in the pump case and integrally connected to the outer circumferential surface of the rotor;

a plurality of stator blades integrally connected to the pump case so that the rotor blades and the stator blades are alternately positioned and arranged;

a drive motor for rotating the rotor shaft; and a balancing body disposed on the inner circumferential surface of the rotor for balancing the rotor during rotation thereof, balancing body being made of a synthetic resin adhesive resistant to heat and corrosion and selected from the group consisting of an epoxy resin, a silicon resin, a polyamide resin, and a polyimide resin.

2. A vacuum pump according to claim 1; wherein the synthetic resin adhesive contains a metal oxide selected from the group consisting of an aluminum oxide, a silicon oxide, and a chromium oxide.

3. A vacuum pump according to claim 1; wherein the synthetic resin adhesive contains a stainless steel powder.

4. A vacuum pump according to claim 1; wherein the synthetic resin adhesive contains ceramic fibers.

5. A vacuum pump according to claim 1; wherein the synthetic resin adhesive contains a metal oxide selected from the group consisting of $Al_2O_3$, $SiO_2$ and $Cr_2O_3$.

6. A vacuum pump comprising:

a pump case having a gas suction port at an upper surface thereof;

a rotor shaft mounted in the pump case for undergoing rotation;

a rotor connected to the rotor shaft for rotation therewith, the rotor having inner and outer circumferential surfaces coated with a corrosion-resistant film treated by nonelectrolytic plating and a groove formed in the inner circumferential surface of the rotor;

a plurality of rotor blades disposed in the pump case and integrally connected to the outer circumferential surface of the rotor;

a plurality of stator blades integrally connected to the pump case so that the rotor blades and the stator blades are alternately positioned and arranged;

a drive motor for rotating the rotor shaft; and a mass comprised of one of an adhesive and a coating made of a heat and corrosion resistant material disposed in the inner circumferential surface of the rotor for increasing the mass of the rotor.

7. A vacuum pump according to claim 6; wherein the mass comprises an adhesive made of a heat and corrosion resistant synthetic resin material selected from the group consisting of epoxy resin, a silicon resin, a polyamide resin, and a polyimide resin.

8. A vacuum pump according to claim 7; wherein the synthetic resin adhesive contains a metal oxide selected from the group consisting of an aluminum oxide, a silicon oxide, and a chromium oxide.

9. A vacuum pump according to claim 7; wherein the synthetic resin adhesive contains a metal oxide selected from the group consisting of an aluminum oxide, a silicon oxide, and a chromium oxide; and wherein the mass is disposed in the groove formed in the inner circumferential surface of the rotor so as to be flush with the inner circumferential surface of the rotor.

10. A vacuum pump according to claim 7; wherein the mass is disposed in the groove so as to be flush with the inner circumferential surface of the rotor.

11. A vacuum pump according to claim 7; wherein the synthetic resin adhesive contains ceramic fibers.

12. A vacuum pump according to claim 7; wherein the synthetic resin adhesive contains a metal oxide selected from the group consisting of $Al_2O_3$, $SiO_2$ and $Cr_2O_3$.

13. A vacuum pump according to claim 6; wherein the mass comprises a coating of an alkyd resin.

14. A vacuum pump according to claim 13; wherein the mass is disposed in the groove so as to be flush with the inner circumferential surface of the rotor.

15. A vacuum pump according to claim 6; wherein the mass is disposed in the groove so as to be flush with the inner circumferential surface of the rotor.

16. A vacuum pump comprising:

a pump case having a gas suction port at an upper surface thereof;

a rotor shaft mounted in the pump case for undergoing rotation;

a rotor connected to the rotor shaft for rotation therewith;

a plurality of rotor blades disposed in the pump case and integrally connected to the outer circumferential surface of the rotor;

a plurality of stator blades integrally connected to the pump case so that the rotor blades and the stator blades are alternately positioned and arranged;

a drive motor for rotating the rotor shaft;

a stainless steel washer integrally connected to an outer circumferential surface of the rotor shaft, the stainless steel washer having an annular surface and a least one hole extending through the annular surface for receiving a connecting member for connecting the rotor to the rotor shaft; and a mass connected to the annular surface of the stainless-steel washer for increasing the mass of the rotor, the mass being selected from the group consisting of a screw, a cotter pin, and a bushing.

17. A vacuum pump according to claim 16; wherein the mass has a gas vent hole extending through an axial center of the mass.

18. A vacuum pump comprising:

a pump case having a gas suction port at an upper surface thereof;

a rotor shaft mounted in the pump case for undergoing rotation;

a rotor connected to the rotor shaft for rotation therewith, the rotor having inner and outer circumferential surfaces coated with a corrosion-resistant film treated by nonelectrolytic plating;

a plurality of rotor blades disposed in the pump case and integrally connected to the outer circumferential surface of the rotor;

a plurality of stator blades integrally connected to the pump case so that the rotor blades and the stator blades are alternately positioned and arranged;

a drive motor for rotating the rotor shaft; and a balancing body comprised of a coating of heat and corrosion resistance material disposed on the inner circumferential surface of the rotor for balancing the rotor during rotation thereof.

19. A vacuum pump according to claim 18; wherein the coating comprises an alkyd resin.

20. A vacuum pump comprising:

a pump case;

a rotor mounted in the pump case for undergoing rotation;

a plurality of rotor blades disposed in the pump case and integrally connected to the rotor for rotation therewith;

a plurality of stator blades integrally connected to the pump case and configured to interact with the rotor blades for performing an evacuating operation; and balancing means comprised of a balancing body connected to an inner circumferential surface of the rotor for balancing the rotor during rotation thereof.

21. A vacuum pump according to claim 20; wherein the balancing body is made of a synthetic resin adhesive material.

22. A vacuum pump according to claim 20; wherein the balancing body comprises a coating of an alkyd resin.

23. A vacuum pump according to claim 20; wherein the rotor has a groove formed in the inner circumferential surface thereof; and wherein the balancing body is disposed in the groove of the rotor.

24. A vacuum pump according to claim 23; wherein the balancing body is flush with the inner circumferential surface of the rotor.

25. A vacuum pump comprising:

a pump case;

a rotor mounted in the pump case for undergoing rotation;

a rotor shaft for rotating the rotor;

a connecting structure for connecting the rotor to the shaft;

a plurality of rotor blades disposed in the pump case and integrally connected to the rotor for rotation therewith;

a plurality of stator blades integrally connected to the pump case and configured to interact with the rotor blades for performing an evacuating operation; and balancing means comprised of a balancing body connected to the connecting structure for balancing the rotor during rotation thereof.

26. A vacuum pump according to claim 25; wherein the connecting structure comprises a washer having a through-hole and a connecting member for connecting the washer to the rotor; and wherein the balancing body is connected to the washer.

27. A vacuum pump according to claim 6; wherein the synthetic resin adhesive contains a stainless steel powder.

* * * * *